United States Patent [19]

McCullough

[11] Patent Number: 4,704,071

[45] Date of Patent: Nov. 3, 1987

[54] METHOD AND APPARATUS FOR PUMPING LIQUIDS

[76] Inventor: Ross M. McCullough, 4101, Bath Road, Kingston, Ontario, Canada

[21] Appl. No.: 875,071

[22] Filed: Jun. 17, 1986

[51] Int. Cl.[4] ..... F04B 23/14

[52] U.S. Cl. ..... 417/85; 417/118; 417/203; 417/205; 239/251

[58] Field of Search ..... 417/88, 118, 201, 203, 417/205, 136; 239/251, 263.1, 225.1

[56] References Cited

U.S. PATENT DOCUMENTS

| | | | |
|---|---|---|---|
| 2,416,193 | 2/1947 | Meyers | 417/203 |
| 2,437,103 | 3/1948 | Leach | 239/225.1 X |
| 2,509,377 | 5/1950 | Trask | 417/203 |
| 2,834,044 | 5/1958 | Antonsen et al. | 239/225.1 X |
| 3,672,791 | 6/1972 | Zimmerly | 417/205 |
| 4,462,739 | 7/1984 | Meyer et al. | 239/225.1 X |

*Primary Examiner*—Carlton R. Croyle
*Assistant Examiner*—Theodore Olds
*Attorney, Agent, or Firm*—Richard J. Hicks

[57] ABSTRACT

An apparatus and method for raising liquids from one level to a higher level by means of a centrifugal pump operating in air for minimum drag, is described. A sealed tank is half filled with liquid and the remaining space is subjected to an externally applied pressure, thereby raising the liquid in a tank exit tube to a height determined solely by the pressure in the tank. Further liquid is introduced into the tank, against the pressure therein, by means of a rotating inlet tube provided with a plurality of radially extending exit tubes which rotate about a vertical axis in the air space above the liquid in the tank. The inlet tube is rotated by means of an electric or other power source located either internally or externally of the tank.

7 Claims, 4 Drawing Figures

METHOD AND APPARATUS FOR PUMPING LIQUIDS

FIELD OF INVENTION

This invention relates to an apparatus for pumping a liquid from one level to a higher level. More particularly this invention relates to a simple centrifugal pump, operating in air, for raising water against a relatively high hydrostatic head.

BACKGROUND OF INVENTION

Centrifugal pumps to raise water or other liquids are, of course well known; but generally they are not particularly efficient as they operate within the liquid to be raised and are, therefore, subject to considerable drag.

It is also known that water can be raised by entraining air in water falling from a considerable height, such as a waterfall, and compressing that air within a chamber at the bottom of the fall thereby creating a hydrostatic pressure in an outlet tube which forces the water upwardly. In the alternative the entrained and entrapped air can be used as a source of compressed air for driving equipment such as rock drills. One such device has been operating on this principle in Cobalt, Ontario, since 1910. This device is not particularly efficient and relies for its success upon ready availability of relatively large volumes of water with a large head, the potential energy of which would otherwise be wasted.

OBJECT OF THE INVENTION

An object of the present invention is to provide a simple centrifugal pump for raising water or other liquids, using air as the medium for creating the pressure to sustain a hydrostatic head and in which to operate the externally powered centrifugal pump.

Another object of the invention is to provide an efficient method for raising liquids from one level to a higher level by means of an inexpensive centrifugal pump.

In satisfaction of the above objects, there is provided by one aspect of this invention an apparatus for raising liquids from a lower inlet level to a higher outlet level comprising: a substantially airtight tank having liquid inlet and exit means; means to pressurize said tank; means rotatable about a vertical axis, above a liquid level within said tank, in liquid communication with said liquid inlet means and provided with liquid exit means, whereby liquid may be introduced through said inlet means into said tank, when pressurized, by centrifugal force; and motor means for rotation of said rotatable means.

By another aspect of the invention there is provided a method for raising liquids from a lower level to a higher outlet level comprising:

providing a sealed tank having a liquid inlet and outlet thereto, powered means rotatable about a vertical axis within said tank and in liquid communication with said inlet; filling said sealed tank to a level below said rotatable means with a liquid;

pressurizing said tank above said liquid and thereby raising said liquid in said outlet to a selected hydrostatic head;

rotating said rotatable means at a speed sufficient to generate a centrifugal force on said liquid introduced thereto to overcome the hydrostatic head in said tank and thereby introduce said liquid into said tank; and withdrawing liqid from said outlet, in an amount corresponding to said liquid introduced into said tank through said rotatable means.

DETAILED DESCRIPTION OF PREFERRED EMBODIMENTS

Figure 1:
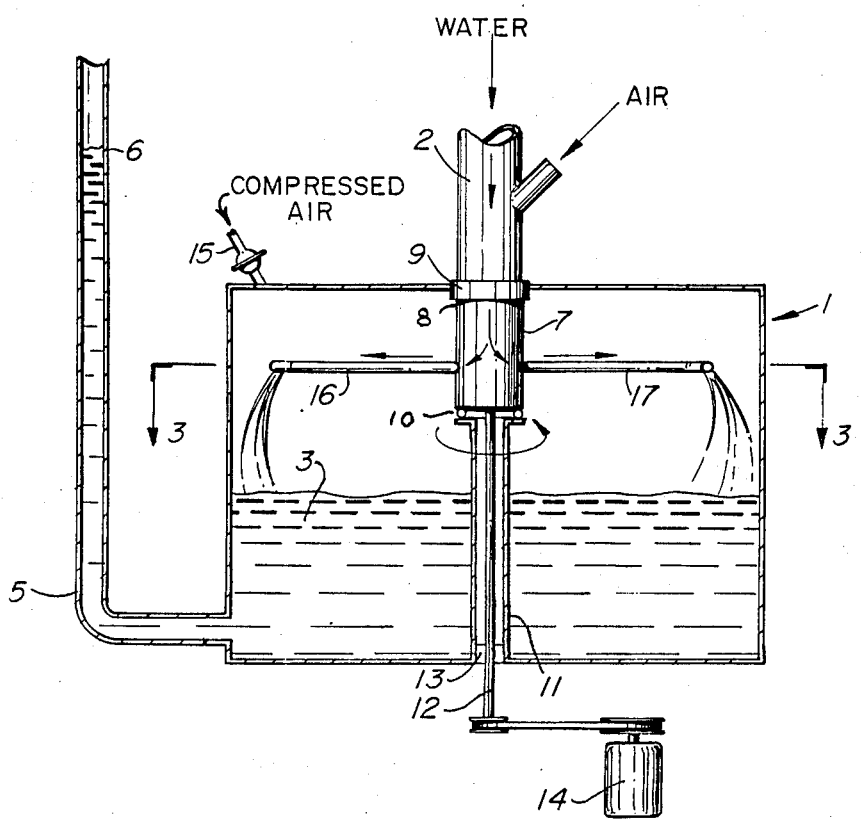
FIG. 1 is a schematic cross-sectional view of the embodiment of the invention.
Figure 3:
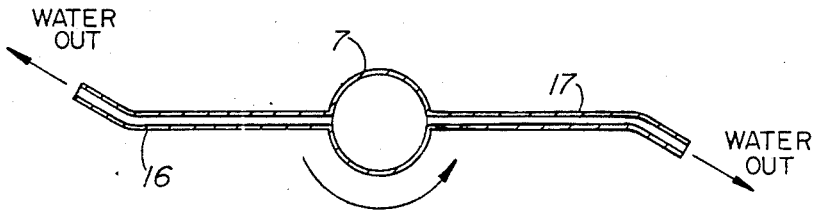
FIG. 3 is a cross-section of the embodiment shown in FIG. 1 taken on line 3—3.

In FIG. 1 there is shown a pressure tank 1 made from any convenient material such as steel or concrete. As the description proceeds, it will be appreciated that the tank 1 could be a pressure-sealed excavation in natural rock. Water is introduced to tank 1 via water inlet 2, to be described in more detail below. The space above the water level 3 in tank 1 is air filled at a pressure of p, of the order of 5–30 psig. Initially the pressure p is obtained by means of an external source such as an air-compressor 15. Once the pressure p is established, however, the air-compressor is no longer needed and may be shut off and/or removed. Any means for providing pressure p, is of course contemplated, including compressed air cylinders. The pressure p exerts a pressure on water level 3 and water is forced up outlet pipe 5 to a level 6, the height of which is of course dependent under eqilibrium conditions to pressure p. If more water is introduced into Tank 1, against the pressure p, it is clear that an equivalent amount of water will be discharged from outlet 5 in order to maintain the pressure p, constant, in accordance with the Gas Laws. It is equally obvious that in order to introduce water into tank 1 against pressure p, work must be done on the water. Clearly this work could be developed by a hydrostatic head at inlet 2, but this would have to be higher than the level 6 of the outlet 5, and clearly there would be no advantage in using such an expedient. instead, there is provided internally of tank 1, a rotatable, vertically oriented inlet tube 7 journalled at its upper end 8 in an airtight seal 9 and in fluid communication with water inlet 2. The lower end of tube 7, which is above water level 3, is supported on a 1 twist bearing 10 which is in turn supported by a hollow tube 11, in which a shaft 12 is rotated about a vertical axis. Shaft 12 is rigidly connected to tube 7 so as to rotate therewith. A gas-tight seal 13 is provided in tube 11, and shaft 12 is roatated by means of an electric motor 14 in conventional manner. Arms 16, 17 project radially from tube 7, which may curve toward a tangential exit thereto. Upon rotation of tube 7 by motor 14, water from inlet 2 is flung by centrifugal force into the pressurized space above water level 3. This either raises the pressure p, or alternatively causes water to be discharged at outlet 6. As the tank 1 is effectively airtight, it will be seen that an equivalent volume of water will normally be discharged from exit 6. Should the pressure p tend to fall it may easily be re-established by injecting more water through tubes 16, 17 or by introducing more compressed air from an external source 16; generally, however, once pressure p is established the external source is no longer required.

Figure 2:
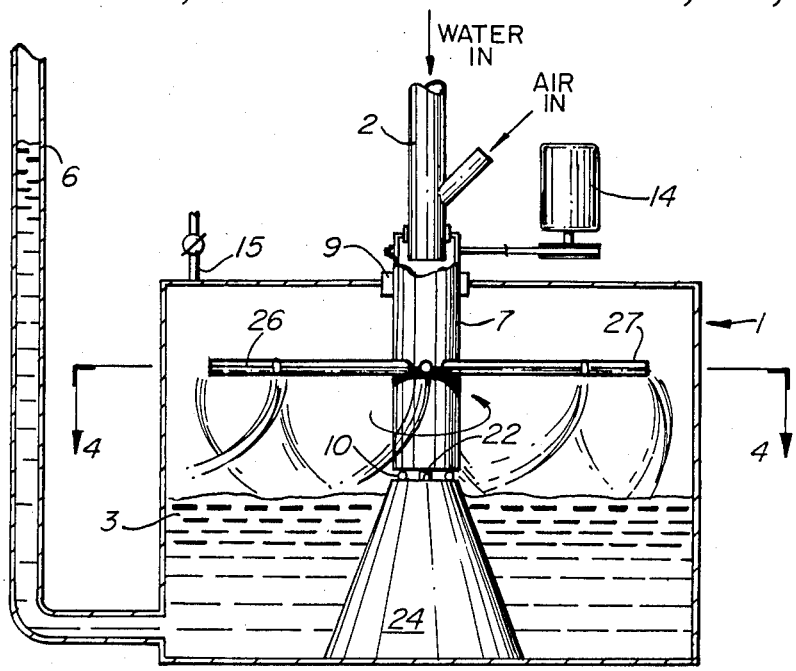
FIG. 2 is a schematic cross-sectional view of an alternate embodiment of the invention.
Figure 4:
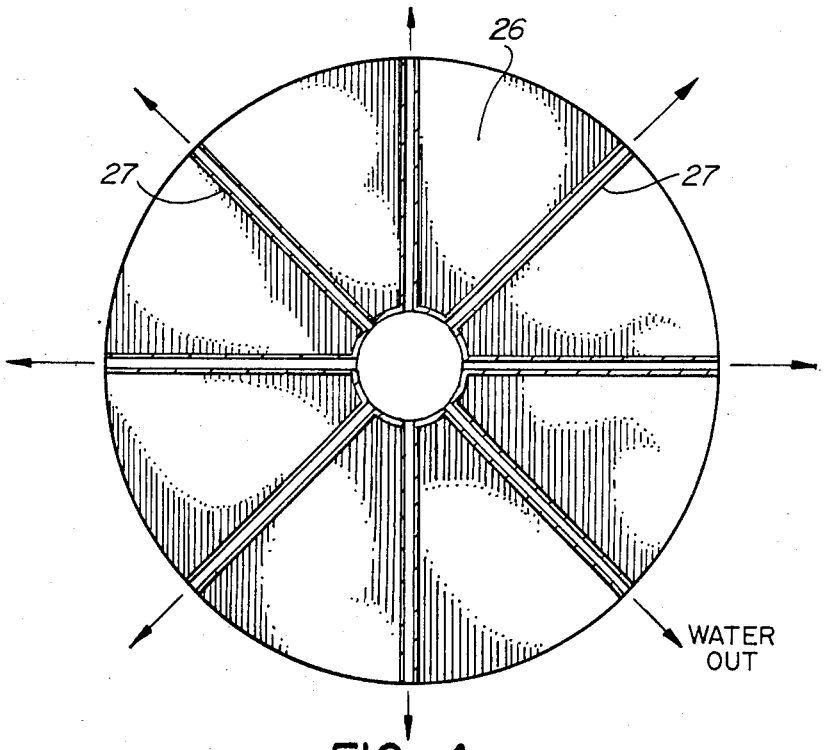
FIG. 4 is a cross-section of the embodiment shown in FIG. 2, taken on line 4—4.

It will be appreciated that as arms 16, 17 are rotating in air, as opposed to water in the case of a conventional centrifugal pump, the drag thereon is relatively low, and the efficiency of the pump is substantially increased. In order to increase further the efficiency of the pump, the arms 16, 17 may be replaced, as shown in in the embodiment of FIGS. 2 and 4, by a circular disc means 26, provided with a plurality of radial extending discharge tubes 27, through which water may be forced into the tank 1. The precise configuration of the external disc means 26 and the design of the exits of tube 27 are a matter of design choice, and may be optimized to provide minimum aerodynamic drag and maximum centrifugal discharge energy. Other modifications will, of course, readily suggest themseleves to persons skilled in the art. One such modification is shown in FIG. 2 wherein the tube 11 and shaft 12 and seal 13 are eliminated by supporting the lower end of tube 7 on a pivot 22 and bearing 10 on a support 24, the upper end of which extends above water level 3. In this case the tube 7 extends through upper gas-tight seal 9 and is rotated by a conventional means, such as an electric motor and belt drive 14 placed at any convenient location adjacent thereto. In another embodiment (not shown), the motor 14 may be located within tank 1, thereby eliminating the need for airtight rotating seal 4. Instrumentation such as speed controllers, pressure guages and safety valves may of course be incorporated in accordance with conventional engineering practice.

EXAMPLE

A sealed tank, as illustrated in FIG. 1, having a volume of 4000 cu.ft., was filled with water to a depth of 48" and pressurized by external means to a pressure of 40 psig. Shaft 12 was rotated at 3600 rpm by means of a 1 H.P. electric motor, so that arms 16, 17 had a tip speed of 17.7 revs per second. Water was discharged at a rate of 8.6 lb/s through the rotating tube 7 and water was discharged from exit 6, at a height of 58 ft. above the level of the water in the tank, at the rate of 8.6 lb/s. The pressure in the tank remained substantially constant and, following the initial pressurization, no further externally supplied air was necessary.

I claim:

1. An apparatus for raising liquids from a lower inlet to a higher outlet level comprising:

a substantially airtight tank having liquid inlet and exit means:

means to pressurize said tank;

means rotatable about a vertical axis, above a liquid level within said tank, in liquid communication with said liquid inlet means and provided with liquid exit means, whereby liquid may be introduced through said inlet means into said tank, when pressurized, by centrifugal force;

motor means for rotation of said rotatable means.

2. An apparatus as claimed in claim 1, wherein said rotatable means comprises at least two radially extending arms.

3. An apparatus as claimed in claim 2, wherein said liquid exit means are tangential to said radial arms.

4. An apparatus as claimed in claim 1, wherein said rotatable means comprises disc means having a plurality of radially extending tubes forming said liquid exit means.

5. An apparatus as claimed in claim 1 wherein said motor means comprises an electric motor.

6. An apparatus as claimed in claim 1, wherein said motor is external of said tank.

7. A method for raising liquids from a lower level to a higher outlet level comprising:

providing a sealed tank having a liquid inlet and outlet thereto, powered means rotatable about a vertical axis within said tank and in liquid communication with said inlet; filling said sealed tank to a level below said rotatable means with a liquid;

pressurizing said tank above said liquid and thereby raising said liquid in said outlet to a selected hydrostatic head;

rotating said rotatable means at a speed sufficient to generate a centrifugal force on said liquid introduced thereto to overcome the hydrostatic head in said tank and thereby introduce said liquid into said tank; and withdrawing liquid from said outlet, in an amount corresponding to said liquid introduced into said tank through said rotatable means.

* * * * *